United States Patent [19]

Evangelos et al.

[11] Patent Number: 5,014,488

[45] Date of Patent: May 14, 1991

[54] METHOD FOR INSTALLATION OF BUILDING TILES WITHOUT ADHESIVE MATERIALS AND STANDARDIZED TILES FOR IMPLEMENTING THE SAME

[76] Inventors: Grigoropoulos Evangelos; Vallianatos Evangelos, both of P.O. Box 3884, GR-102 10 Athens, Greece

[21] Appl. No.: 446,623

[22] Filed: Dec. 6, 1989

[51] Int. Cl.[5] ..... E04B 1/00; E04G 21/00

[52] U.S. Cl. ..... 52/746; 52/748; 52/220; 52/384; 52/390; 52/477

[58] Field of Search ..... 52/384–392, 52/510, 792, 578, 220, 221, 746–748, 476, 477

[56] References Cited

U.S. PATENT DOCUMENTS 963,889 7/1910 Goodwin ..... 52/792
1,344,181 6/1920 Mason ..... 52/510
1,866,527 7/1932 Dinkins ..... 52/578
1,896,188 2/1983 Shanklin ..... 52/510

*Primary Examiner*—James L. Ridgill, Jr.

[57] ABSTRACT

The present invention relates to a new method for the installation of building tiles without any adhesive materials (fine grained sand and cement or glues) or joint fillers (e.g. stucco), directly onto a bare wall or floor without any prior preparation of the latter. This method shows substantial advantages and is implemented using frame-plates mountable onto the wall or floor and standardized tiles with engagement means, suitable to match corresponding engagement means of the frame plates.

An illustrative view of the installation process with the frame plates and tiles of the invention is presented in FIG. 16.

5 Claims, 4 Drawing Sheets

METHOD FOR INSTALLATION OF BUILDING TILES WITHOUT ADHESIVE MATERIALS AND STANDARDIZED TILES FOR IMPLEMENTING THE SAME

THE FIELD OF THE ART

The present invention is related to the field of the art of building tiles, such as those being used as floor tiles or wall tiles, as well as for covering any other horizontal, vertical or inclined surface, as well as to the methods of installation of tiles onto such surfaces.

THE PRIOR ART

Usage of tiles made from ceramics, marble or other materials and alloys of various materials in covering floors and walls of buildings is well known and broadly available. Usage of tiles is more and more widespread, as progress is made both in the art of manufacturing tiles and in the quality and variety of designs, colours, etc. The installation of tiles is currently effected in two different methods. The first method consists in the building of the tiles onto the unplastered wall, where cement and fine grained sand are the adhesive materials used. The second method consists in glueing the tiles onto the wall, where in this case the wall has to be plastered prior to installing the tiles, so that its surface might be smooth and thus to enable the special glues employed as adhesive materials in this second method to act properly in the installation process. Wooden structures might also be used to form the smooth surface onto which the tiles are glued. It thereby follows that all abovementioned methods of the prior art make use of one or the other adhesive material, either sand-cement or glues for installing the tiles. This is the reason that the abovementioned methods of installing tiles exhibit a series of disadvantages both with regard to the consumption of manpower and raw materials and with regard to the qualitative characteristics of the final product.

Installation of tiles by means of glueing requires an absolutely smooth and even, planar surface, since glues cannot act effectively if abnormalities are encountered. In the case of employing fine grained sand and cement to install the tiles onto a bare, unplastered wall, smoothness of the surface is not necessary, but this process is much more time consuming because of the care that has to be taken in order to produce a level surface, such levelling requirement being dependent on the skill of the employed labour. Furthermore repair work comprising removing some tiles and replacing them with new ones is a very difficult and substantially expensive process.

Both the abovementioned methods of tile installation of the prior art are disadvantageous, since they add substantial loads on the building, either because of the adhesive material when the tiles are built onto the wall or because of the necessary plastering used prior to the alternative method of glueing the tiles. A further disadvantage of the glued tiles in particular is their sensitivity in humidity, resulting to an inferior behaviour of the same, both with regard to humidity and with regard to their inherent strength, since their fracture might easily take place either as a result of violent events, such as an earthquake or as a result of changes in the ambient conditions.

Furthermore the requirement of skilled labour often causes problems when trying to find suitable technicians to install the tiles, whereas defective labour often leads to permanent aesthetic disadvantages.

Finally both abovementioned methods of tile installation of the prior art entail the additional disadvantage of the installation being of a permanent nature and thereby aesthetically defining each particular part of wall and/or floor covered with the tiles. Furthermore, the hydraulic and electrical installations are also permanently covered and thereby obvious difficulties are encountered if such installations have to be repaired.

A first object of the present invention is to effectively overcome the disadvantages and drawbacks of the prior art and to provide standardized wall or floor tiles installable without using any adhesive material, this resulting to the proposed tiles being of a very low production cost and their method of installation being cheap and requiring comparatively minimal time.

A further object of the invention is to provide the ability of an easy and rapid replacement of tiles if such replacement is required either for aesthetic reasons or for repairing the hydraulic or electric installations enclosed therein.

A further object of the invention is to provide the proposed standardized tiles at a high grade of safety, fully waterproof and further provide the opportunity of reducing both the overall cost and the load exerted to the building because of the weight of the tiles, such opportunity being offered by means of using materials of high strength, such as by way of example hard plastic materials, in manufacturing the proposed tiles, which can furthermore cooperate special structures to render desirable heat and sound insulation characteristics.

Another object of the present invention is to provide a series of new standardized accessories to be used in conjunction with the proposed tiles and the method of their installation in the present invention, such as by way of example suspension hooks, mirrors, towel suspension accessories, cases and holders for soap and other sanitary articles which are ordinarily used in the rooms where wall tiles are traditionally installed, such accessories being up today mainly provided either as buildable or screwable accessories.

A final object of the present invention is to extend the field of applications of the invention into broader fields of application of the same method of the invention, such as by way of example into manufacturing partition panels, furniture, false roofs, standardized roofing tiles, etc.

These and other objects, advantages and characteristics of the present invention are achieved with a method in which the tiles of the invention are assembled by means of mutual engagement of a suitable series of protrusions provided on their internal surface into a corresponding series of recessions provided at the external surface of a special reception panel mounted onto the wall or floor.

BRIEF DESCRIPTION OF THE DRAWINGS

The invention will be clearly understood by those skilled in the art by reference to the accompanying drawings, wherein the invention is depicted in an illustrative manner.

FIG. 17 shows a perspective view of an arrangement of frame plates with hydraulic pipes/electrical cables or other pipe and/or cable networks 22 passing through an arrangement of longitudinally extending vertically and horizontally oriented allignment channels 5.

DETAILED DESCRIPTION OF THE INVENTION

By reference to the accompanying drawings, we will hereinafter describe certain illustrative embodiments of the invention.

The following elements are used in implementing the method of the present invention:

The tile supporting frame plates 1,

The standardized tiles 2 and various accessories described hereinafter.

The above elements are made in standard sizes, preferably from hard plastic, although they may be made from other occasionally desired materials, such as by way of example ceramics, marble, wood, glass or any combination of desired materials.

The drawings generally depict a quadrilateral and in particular a square form of the frame plates 1 and of the standardized tiles, both of which might however be made in any other desired form. In particular, tiles 2 may vary in form, so as to render in conjunction with preferred preprinted pictures a desired, aesthetic, external appearance. The internal frame plates 1 may keep the same standard form, e.g. the depicted square form, irrespective of the form that the external standardized tiles 2 might have.

Figure 1:
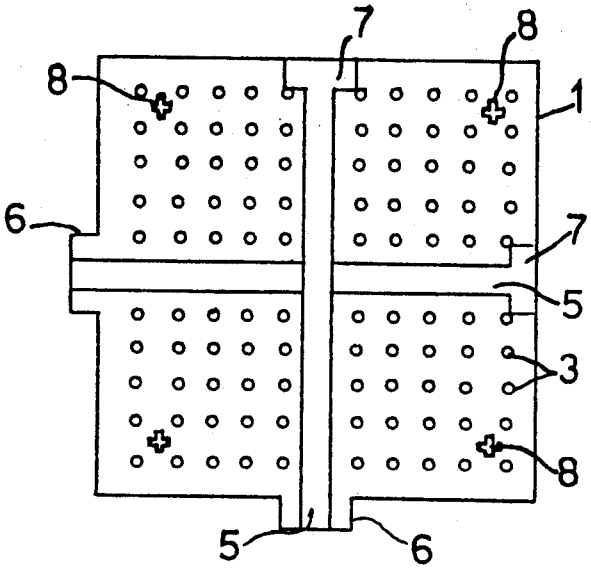
FIG. 1 shows a view of the front surface of the tile supporting frame plate.
Figure 2:
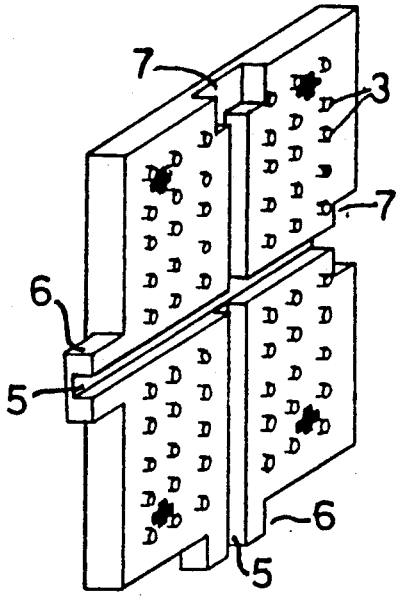
FIG. 2 shows a perspective view of the front surface of the tile supporting frame plate of FIG. 1.

As depicted in FIGS. 1 and 2, the front surface of each tile supporting frame plate 1 comprises a symmetric or assymmetric arrangement of recessions 3, suitable for a fixed engagement with a corresponding arrangement of protrusions 4 of the standardized tiles 2. The form, number, arrangement and dimensions of the abovementioned recessions 3 and protrusions 4 are in no way confined in those depicted in the drawings, but they can vary as long as a mutual correspondence of the selected recessions and protrusions is retained. The tiles 2 may also be fixed onto the frame plates 1 in various alternative ways. By way of example, linear elements, such as protruding rods and corresponding linear grooves might be used, their engagement being effected along corresponding ridge formations of both tiles and frame plates. Hooks or other fastening elements might also be used.

In accordance to a preferred embodiment of the invention, each standard frame plate 1 is provided with a special edge formation, allowing its handy and stable engagement into its adjacent, correspondingly formed frame plates 1. By way of example as depicted in the accompanying drawings 1–4, a pair of protrusions 6 are provided in the middle of two adjacent sides of frame plate 1, whereas a correspondingly formed pair of recessions 7 are provided in the middle of the remaining two adjacent sides of the same frame plate 1. The protrusions 6 fit into the recessions 7 in the assemblying process of adjacent frame plates 1, whereby the protrusions 6 and corresponding recessions 7 perform a guide function in the assemblying process. Such assemblying and alignment process of the frame plates 1 might also be effected using varying plurality, arrangement and form of the abovementioned protrusions and recessions. Alternatively, the assemblying and alignment process of the frame plates 1 might be conducted in other ways and by other means, such as by way of example by using side grooves and corresponding rod formations, etc.

Figure 3:
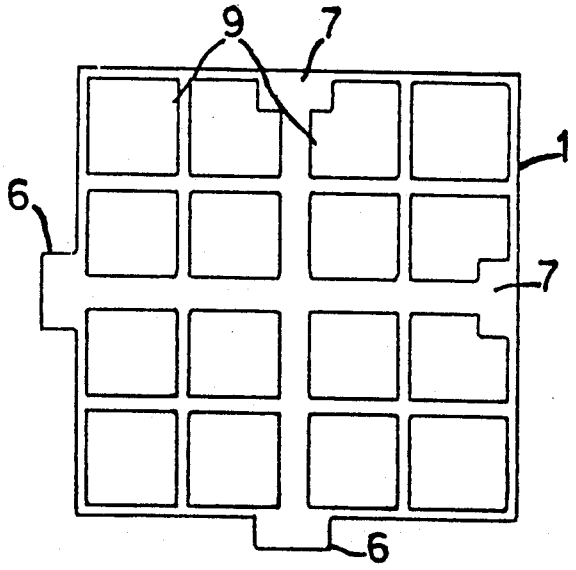
FIG. 3 shows a view of the rear surface of the tile supporting frame plate.
Figure 4:
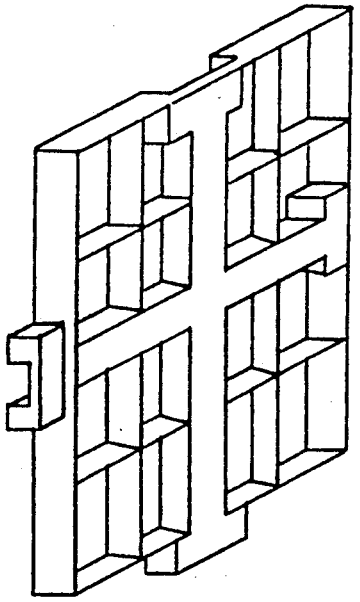
FIG. 4 shows a perspective view of the rear surface of the tile supporting frame plate.
Figure 5:
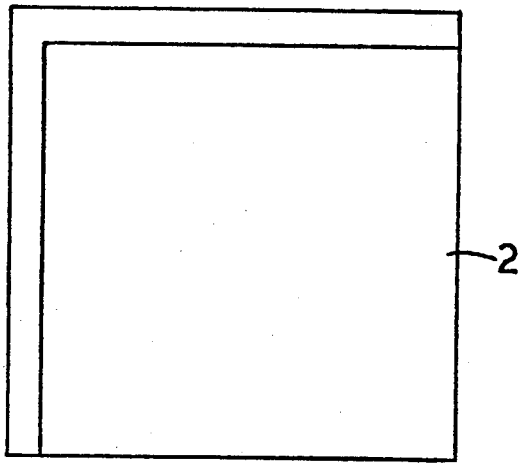
FIG. 5 shows a view of the front external surface of an illustrative tile of the invention.
Figure 6:
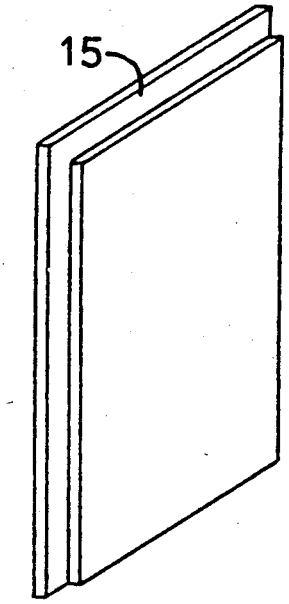
FIG. 6 shows a perspective view of the front external surface of the illustrative tile of FIG. 5.
Figure 7:
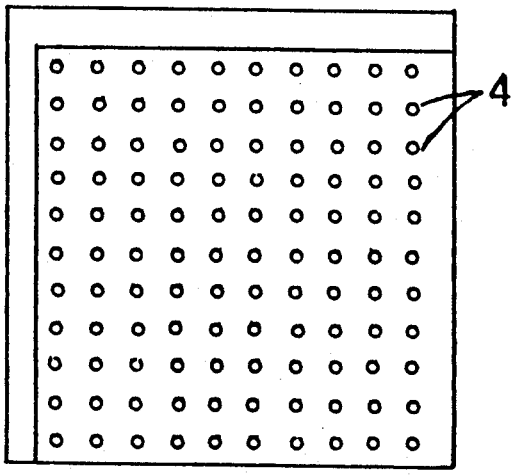
FIG. 7 shows a view of the rear internal surface of the illustrative tile of FIG. 5.
Figure 8:
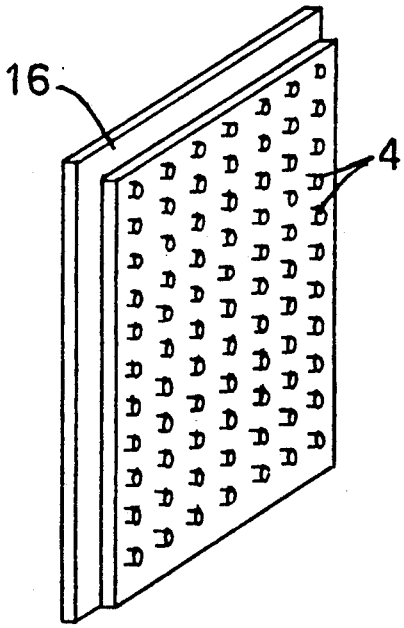
FIG. 8 shows a perspective view of the rear internal surface of the illustrative tile of FIG. 5.

The rear surface of each frame plate 1 (FIGS. 3 and 4) is preferably provided with a series of linear, horizontal and vertical reinforcing ribs 9, so as to ensure the desired strength with the minimum possible waste of material. The abovementioned rear surface of each frame plate 1 can be filled with suitable insulating materials, thereby rendering heat and/or sound insulating properties to the overall structure.

Further, in accordance to an illustrative, preferred embodiment of the invention each frame plate 1 is provided with a suitable arrangement of channels 5, such as by way of example the depicted cross arrangement of channels 5, so as following aligned engagement of a series of the abovementioned frame plates, a plurality of parallel, horizontal and vertical linear channels are formed, within which hydraulic or central heating pipes as well as electrical installation, television etc. cables and pipes, may pass. In this way a substantial reduction of the labour cost involved in these installations is achieved, whereas the shortest course may in this case be followed by such pipes or cables, thereby rendering a reduction of cost with respect to the materials used. Furthermore, the substantial advantage is provided of allowing handy access to these installations at any time to repair possible malfunctions or even in order to partially or completely extend or replace the enclosed electrical or hydraulic installations, or even add new installations which had not been initially included, such as by way of example a natural gas installation.

Each frame plate 1 is also provided with a suitable arrangement of holes 8, whereby bolts pass through these holes to effect mounting of the frame plates 1 onto the wall or floor. FIG. 1 illustrates four such cross-cut holes 8 close to the four corners of each of the frame plates 1, wherefrom bolts pass to mount the frame plate onto the wall or floor, where each of the abovementioned cross-cut holes defines a short horizontal and a short vertical groove, within which the mounting bolts move in order to align each frame plate 1 prior to its eventual fixing onto the wall or floor. Following marking of the location of the abovementioned cross- cut holes, the holes are drilled and plastic bolt reception elements are introduced therein, suitable for the introduction thereinafter of the specially formed bolts depicted in FIG. 11.

Figure 11:
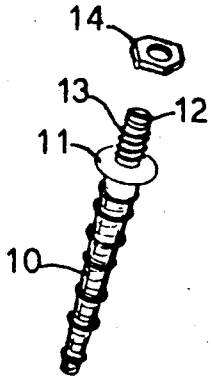
FIG. 11 shows a perspective view of a special form of bolt and nut used in the mounting process of the tile supporting frame plates onto the wall.

As illustrated in FIG. 11, each of the mounting bolts 10 is provided with a washer 11 which is fixedly mounted close to its upper end, an external threading 13 starting above washer 11 whereupon the nut 14 is bolted, nut 14 being provided with an upper slot 12 by means of which it can be driven with a screwdriver.

Fixing of each frame plate 1 comprises driving the bolts 10 into the abovementioned plastic bolt reception elements, introducing the frame plate 1 so as it will fit upon the fixedly mounted washers 11, whereupon bolts 10 are screwed so as to achieve the desired alignment and eventually use the nuts 14 to fixedly mount the frame plate 1 onto the desired position.

The tiles 2 are installed onto the frame plates 1 by means of the engagement effected between the protusions 4 provided onto their internal surface and the corresponding arrangement of recessions 3 of the external surface of the frame plates 1, such engagement being effected by means of a light manually exerted pressure.

In accordance to a preferred illustrative embodiment of the invention, each of the tiles depicted in FIGS. 5-8 is provided with water-proofing protrusions along one pair of its sides and correspondingly shaped water-proofing recessions 16 along the other pair of its sides. During installation each pair of the abovementioned water proofing protrusions 15 of each tile is combined with a corresponding pair of water-proofing recessions 16 of the adjacent tiles, so as to render a water proof engagement along connection lines without having to use any other additional water proofing material, such as the putty used in a conventional tile installation process.

In accordance to the method of installation of tiles of the present invention, a suitable plurality and variety of accessories are used some of which are depicted in an illustrative manner.

Figure 9:
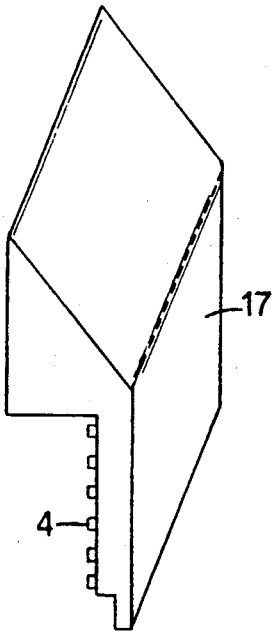
FIG. 9 shows a perspective view of an illustrative tile used in the finishing process of installation close to the ceiling.
Figure 10:
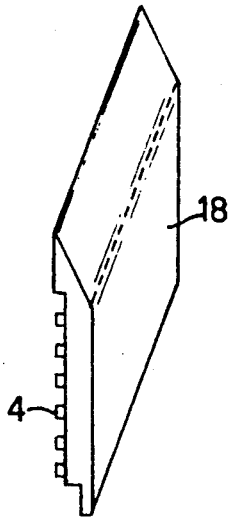
FIG. 10 shows a perspective view of another illustrative form of tile, suitable for finishing work in the process of installation close to the ceiling.

Thus, by way of example, FIGS. 9 and 10 show accessories 17 and 18, which are used in the finishing, close to the ceilings, process during installation of the tiles of the invention. These accessories are provided with the engagement means, i.e. the arrangement of protrusions 4 described above as well as other alternative water-proofing protrusions, but are characterised by that they extend upwards to an inclined portion, the depth of which is such as to coincide on the same plane with protrusions 4 in as fas as piece 18 is concerned, whereas in piece 17 the depth of the depicted inclined upper portion is such as to cover the frame plate 1 underneath and become tangential to the wall.

Figure 13:
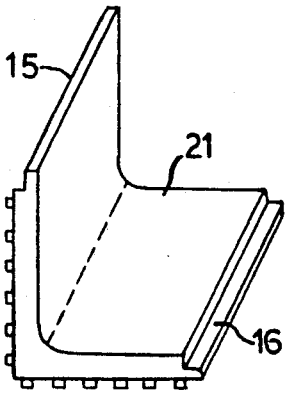
FIG. 13 shows a perspective view of an illustrative form of an angle joint tile, bearing one edge with a water-proofing protrusion and another edge with a water-proofing recession.
Figure 14:
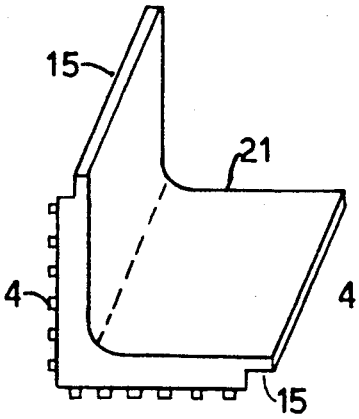
FIG. 14 shows a perspective view of another illustrative form of an angle joint tile bearing water-proofing protrusions on either edge.
Figure 15:
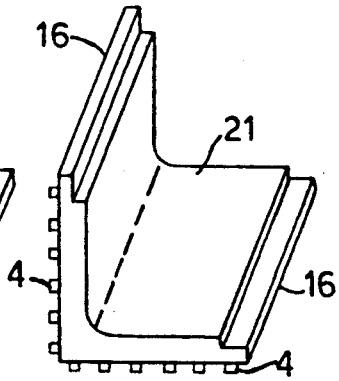
FIG. 15 shows a perspective view of another illustrative form of an angle joint tile bearing water-proofing recessions on either edge.
Figure 16:
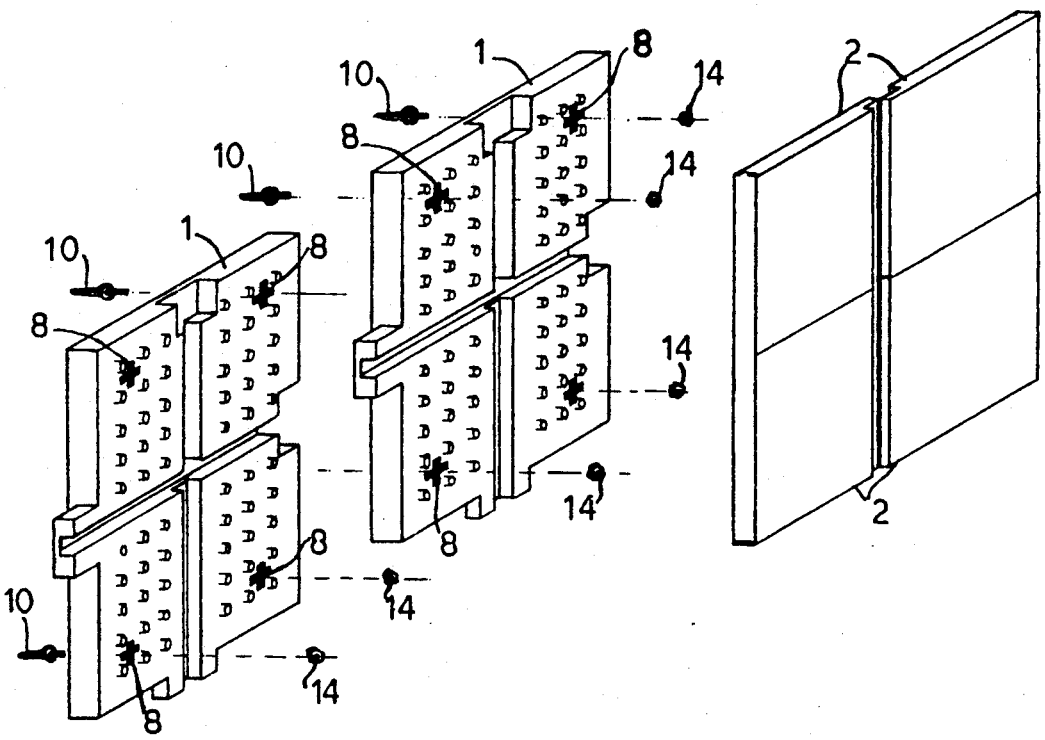
FIG. 16 shows a perspective view illustrative of the installation process of the tiles in accordance to the method of the present invention.

Further, FIGS. 13, 14 and 15 depict three alternative, in as far as the combination of their water-proofing extensions are concerned, types of angle joint tiles 21, where in particular the angle joint tile of FIG. 13 is shown with a water-proofing protrusion 15 on one edge and a water-proofing recession 16 on the other edge, whereas the angle joint tiles of FIGS. 14 and 15 bear water-proofing ptotrusions 15 and recessions 16 on either end respectively. Whereas FIGS. 13-15 show right angled tiles, such angle joint tiles may be provided in a plurality of alternative angles, as well as curved angular pieces, suitable for covering curved walls of any radius of curvature.

Figure 12:
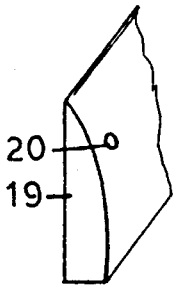
FIG. 12 shows a perspective view of an illustrative piece, suitable for installation close to the floor in conjunction with the tiles of the invention.

Further FIG. 12 shows an illustrative form of a floor lining 19, i.e. a special piece suitable for installation close and normally to the floor, which can be used in conjunction with the tiles of the invention and can be fixed onto the wall by means of a series of bolts passing through holes 20. This floor lining 19, as well as other alternative forms of the same with desired shape and colours can be offered in prefabricated long pieces, which may be cut to length in the installation process.

Several other accessories, such as by way of example hooks, towel suspension hooks, soap cases and other sanitary accessories may be used in conjunction with the tiles of the invention. Specially formed pieces might also be used to produce false roofs, roof tiles, partition panels, decorative articles, furniture, etc.

The above clearly illustrates the advantages of the method of installation of tiles proposed in the present invention, which can be accomplished by any unskilled person without any prior preparation but straight onto a bare wall or floor with a bare concrete surface or surface already covered with other materials such as old-fashioned tiles, marble, plastics, etc.

It must hereby be noted that the above description was made by reference to illustrative but not confining examples. Thus any change or amendment relating to the shape, size, dimensions, materials used in the manufacturing process, variations in the accessories or the stages involved in the installation process, as long as they do not constitute a new inventive step, must be considered part of the scope and the aims of the present invention.

We claim:

1. Method for the installation of building tiles without adhesive materials, comprising the following stages:

mounting a vertically and horizontally oriented serial arrangement of plastic frame plates onto a bare unplastered planar or curved surface, each of said frame plates having longitudinally extending, vertically and horizontally oriented allignment channels, said channels alternately extending into mutually fitting protrusions and recessions forming said longitudinally extending channels, and fitting a series of plastic standardized tiles upon said serial arrangement of frame plates, the external perimeter of each tile being formed with an arrangement of alternately extending protrusions and correspondingly shaped recessions, where in the assembly process each said protrusion is accurately inserted within said correspondingly shaped recession of an adjacent tile, thereby forming an overall planar tile-covered surface with vertically and horizontally running lines of cohesion, whereupon no water-proofing filler is required because of the broken-line section of each of said vertically and horizontally running lines of cohesion, where fitting of said series of plastic standardized tiles upon the previously installed said serial arrangement of plastic frame plates is performed when by means of a manually exerted slight pressure an arrangement of protrusions provided on the internal surface of each said tile is removably buttoned upon a corresponding arrangement of recessions provided on the external surface of each said frame plate.

2. The method for the installation of building tiles without adhesive materials of the above claim 1, where hydraulic pipes or electrical cables or TV cables or other pipe and/or cable networks pass through said longitudinally extending vertically and horizontally oriented allignment channels.

3. The method for the installation of building tiles without adhesive materials of the above claim 1, further comprising the step of packing the rear surface of said plastic frame plates with suitable insulating materials to render desired heat and/or sound insulating properties.

4. The plastic frame plate of claim 1, comprising said longitudinally extending, vertically and horizontally oriented allignment channels with alternately extending protrusions and recessions which are mutually fitted in sequential frame plates thereby forming a serial arrangement of said plastic frame plates, the external surface of each said plastic frame plate being provided with an arrangement of recessions buttonable upon a correspondingly shaped arrangement of protrusions provided onto the internal surface of each covering tile, and where each said plastic frame plate further comprises an arrangement of cross-cut holes allowing minor allignment movement when bolts are used to screw said frame plate upon the desired surface.

5. The plastic standardized tile of claim 1, the external perimeter of each tile being formed with an arrangement of alternately extending protrusions and correspondingly shaped recessions, where each said protrusion is accurately inserted within an adjacent correspondingly shaped recession in the assembly process, thereby forming a broken-line section of each of said vertically and horizontally, fully water proof, running lines of cohesion without necessitating any water-proofing filler, the internal surface of each said plastic standardized tile being provided with an arrangement of protrusions by means of which it is removably buttoned upon a correspondingly shaped arrangement of recessions of the external surface of each of said plastic frame plates.

* * * * *